US009033930B2

(12) United States Patent
Griffith et al.

(10) Patent No.: US 9,033,930 B2
(45) Date of Patent: May 19, 2015

(54) BASE FOR AN ENTERAL FEEDING DEVICE

(75) Inventors: Nathan C. Griffith, Roswell, GA (US); Donald J. McMichael, Roswell, GA (US); John A. Rotella, Roswell, GA (US)

(73) Assignee: Avent, Inc., Alpharetta, GA (US)

( * ) Notice: Subject to any disclaimer, the term of this patent is extended or adjusted under 35 U.S.C. 154(b) by 265 days.

(21) Appl. No.: 13/334,258

(22) Filed: Dec. 22, 2011

(65) Prior Publication Data

US 2013/0165862 A1 Jun. 27, 2013

(51) Int. Cl.
*A61J 15/00* (2006.01)

(52) U.S. Cl.
CPC ..... *A61J 15/0065* (2013.01); *A61J 15/0042* (2013.01); *A61J 15/0015* (2013.01)

(58) Field of Classification Search
CPC ..... A61J 15/0065; A61J 15/0042; A61J 15/0015; A61J 15/0026
USPC ..... 604/174, 164.01–164.04
See application file for complete search history.

(56) References Cited

U.S. PATENT DOCUMENTS

| | | | | |
|---|---|---|---|---|
| D189,389 | S | 11/1960 | McGiveran et al. | |
| 3,915,171 | A | 10/1975 | Shermeta | |
| 4,315,513 | A | 2/1982 | Nawash et al. | |
| 4,666,433 | A | 5/1987 | Parks | |
| 4,798,592 | A | 1/1989 | Parks | |
| 4,944,732 | A | 7/1990 | Russo | |
| 5,092,847 | A | 3/1992 | Pozzo | |
| 5,242,389 | A | 9/1993 | Schrader et al. | |
| 5,342,321 | A * | 8/1994 | Potter | 604/174 |
| 5,484,420 | A | 1/1996 | Russo | |
| 5,846,221 | A | 12/1998 | Snoke et al. | |
| 5,997,503 | A | 12/1999 | Willis et al. | |
| 5,997,546 | A | 12/1999 | Foster et al. | |
| 6,464,686 | B1 * | 10/2002 | O'Hara et al. | 604/539 |
| 7,070,587 | B2 | 7/2006 | Meier et al. | |
| D589,143 | S | 3/2009 | Mauch | |
| D657,056 | S | 4/2012 | Burgess et al. | |
| 8,177,742 | B1 | 5/2012 | Bagwell et al. | |

(Continued)

FOREIGN PATENT DOCUMENTS

| | | |
|---|---|---|
| EP | EM 000647037-0001 | 1/2007 |
| WO | WO 00/50110 A1 | 8/2000 |
| WO | WO 01/60313 A1 | 8/2001 |

OTHER PUBLICATIONS

Passport® Low Profile Gastrostomy Device, Internet web page "http://www.cookmedical.com/esc/dataSheet.do?id=5691", available from Cook Medical, Inc., of Bloomington, Indiana, viewed and printed Nov. 13, 2012, 1 page.

(Continued)

*Primary Examiner* — Nicholas D. Lucchesi
*Assistant Examiner* — Melissa A Snyder
(74) *Attorney, Agent, or Firm* — Dority & Manning, P.A.

(57) ABSTRACT

An enteral feeding device having an improved base adapted to be deployed outside the human body and a tube which is adapted to be deployed within a lumen or cavity of the body by insertion through a stoma from outside the body is disclosed. The base of the device has a recess directly surrounding at least a portion of the proximal end of the tube to permit increase air flow and minimize contact with the tissue immediately surrounding the stoma to facilitate tissue wellness and reduce patient side effects due to moisture build-up, skin irritation and granulation of the stoma tissue.

6 Claims, 7 Drawing Sheets

(56) References Cited

U.S. PATENT DOCUMENTS

| | | | |
|---|---|---|---|
| D669,578 | S | 10/2012 | Burgess et al. |
| 2006/0052752 | A1 | 3/2006 | McMichael |
| 2010/0100074 | A1 | 4/2010 | Smith et al. |
| 2010/0185159 | A1 | 7/2010 | Bagwell et al. |
| 2011/0152762 | A1 | 6/2011 | Hershey et al. |
| 2012/0029481 | A1 | 2/2012 | Pech et al. |
| 2012/0029483 | A1 | 2/2012 | Griffith et al. |
| 2012/0197192 | A1 | 8/2012 | Bagwell et al. |

OTHER PUBLICATIONS

Mini One™ Non-Balloon Button, available from Applied Medical Technology, Inc., of Brecksville, Ohio, 2010, 8 pages.

Co-pending U.S. Appl. No. 29/409,355, filed Dec. 22, 2011, by Griffith et al. for "Enteral Feeding Tube Base."

Co-pending U.S. Appl. No. 29/409,358, filed Dec. 22, 2011, by Griffith et al. for "Low Profile Feeding Tube Head."

* cited by examiner

BASE FOR AN ENTERAL FEEDING DEVICE

FIELD OF THE INVENTION

The present invention relates to an improved enteral feeding device. More particularly, the present invention relates to an enteral feeding device having an improved base deployed outside the human body, a tube for transfer of material from outside the body to the inside of the body and, optionally, a retainer which is inserted through a stoma from outside the body for deployment within a lumen of the body. The improved base allows for increased air circulation and reduced stoma irritation.

BACKGROUND

Numerous situations exist in which a body cavity needs to be catheterized to achieve a desired medical goal. One relatively common situation is to provide nutritional solutions or medicines directly into the stomach or intestines. A stoma is formed in the stomach or intestinal wall and a tube is placed through the stoma. This surgical opening and/or the procedure to create the opening is common referred to as "gastrostomy". Feeding solutions can be injected through the tube (i.e., a feeding tube) to provide nutrients directly to the stomach or intestines in a procedure generally known as enteral feeding. A variety of different feeding tubes intended for enteral feeding have been developed over the years. These devices are frequently referred to as "gastrostomy tubes", "percutaneous gastrostomy catheters", "PEG tubes", "enteral feeding tubes" or "enteral feeding catheters."

To prevent the PEG tube from being pulled out of the stomach/intestinal wall, various types of retainers are used at a distal end of the catheter. Examples of conventional devices with Malecot tips or similar expanding tips are found in, for example, U.S. Pat. No. 3,915,171 for "Gastrostomy Tube" issued to Shermeta; U.S. Pat. No. 4,315,513 for "Gastrostomy and Other Percutaneous Transport Tubes" issued to Nawash et al.; U.S. Pat. No. 4,944,732 for "Gastrostomy Port" issued to Russo; and U.S. Pat. No. 5,484,420 for "Retention Bolsters for Percutaneous Catheters" issued to Russo. Exemplary commercial products include the Passport® Low Profile Gastrostomy Device available from Cook Medical, Inc. of Bloomington, Ind. and the Mini One™ Non-Balloon Button available from Applied Medical Technology, Inc. of Brecksville, Ohio.

Feeding tubes that are initially placed during the gastrostomy procedure have non-inflatable bumpers, bolsters, Malecot tips or similar expanding tips made of a resilient material. These devices are passed through esophagus of a patient and into the stomach or intestinal space. The narrow tube end of the device is pulled through the stoma and the bolster or bumper which is much larger than the stoma is retained in the stomach or intestinal space to prevent the device from falling out. It is generally thought that the non-inflatable bumper or bolster helps the stoma site heal properly and form a desired shape.

If the feeding tube having the non-inflatable retainer needs to be replaced, it is frequently replaced with a feeding tube that employs an inflatable balloon as the retainer. The balloon, typically made of a "soft" or elastomeric medical grade silicone, is attached to the end of the catheter and is deflated for insertion through the stoma and then inflated to hold the enteral feeding assembly in position.

If the enteral tube is to be left in the stoma for some period of time, it is not uncommon for the tissue immediately surrounding the stoma, itself, to become sensitive to the presence of the components of the device including the base and the catheter or feeding tube. It is known that trapping moisture and not allowing the stoma site to experience air circulation can cause issues such as irritation, granulation tissue formation, infection and other problems. Standard length G-tubes use a slideable retention ring that is placed against the patient's body and most rings have raised pads to distribute the force and openings to allow air passage. See for example U.S. Pat. No. 4,666,433 to Parks. Low-profile devices, also called MIC-KEY devices, rest against the body but most designs do not allow adequate air circulation and/or force distribution. See for example U.S. Pat. No. 5,997,503 to Willis et al. and U.S. Pat. No. 20011/0152762 to Hershey et al. One attempt that has been tried is to raise the head from the body with legs/spacers extending from the body. See for example U.S. Pat. No. 4,798,592 to Parks. WO 01/603313 to Meier et al. discloses a low profile gastrostomy tube with an external retention member having a body with an axial opening and opposed legs which are adapted to abut the outer abdominal wall of a patient. WO 00/50110 to Meier et al. discloses a securing device for a low profile gastrostomy tube. The external retention member includes an annular body and two generally opposing grooves which are formed between respective legs and the annular body. Accordingly there is a need for an enteral feeding device that minimizes contact with the area of tissue immediately surrounding the stoma, especially on the external surface of the stoma.

Another problem with prior enteral feeding tubes is the manner in which the tube is connected or formed at its juncture with the underside of the base or head of the device. Some designs used what are termed bolsters, transition necks or strain relief necks which are areas of added material used to reinforce the juncture between the proximal end of the tube and the underside of the base. The use of this added material, especially when the tubes are formed from silicone rubber, tends to reduce the formation of stress risers in the tube material which can result in leaks in either or both of the inflation lumen and the feeding lumen located in the tube. Leaks in the tube are often the result of the rocking motion the base and tube experience during use as a result of the handling of the device during the administration of food and/or other liquids and drugs as well as the rocking action the device experiences due to the normal movements of the patient. The problem is that the use of this reinforcing material thickens the portion of the device which is in the immediate vicinity of the stoma thereby increasing the contact of the device with the stoma tissue thereby retarding the healing process and reducing the ability of fresh air to circulate around the stoma and promote tissue wellness.

Referring first to FIGS. 1 and 2 of the drawings there is shown a prior art enteral feeding tube assembly 10 including a base 12, a tube 14 and an inflatable balloon 16. As shown in FIG. 2, the assembly 10 extends through a stoma 18 formed in a portion of an animal or human such as the skin or stomach wall 20. The underside 22 of the base 12 rests on and partially in the stoma 18 and the tube 14 extends into the intended portion of the body cavity and is held in place by the inflatable balloon 16. The tube 14 itself typically has one or more fluid channels or lumen. One lumen 24 is used to pass fluids and semi-solid materials such as food, liquids and medications while a second lumen 26 is commonly supplied to allow inflation of the balloon 16. Due to the fact that the person or animal in which the assembly 10 is placed is prone to moving and due to the fact that the assembly is subject to further movement and rocking action when the caregiver is utilizing the assembly 10 to administer food, medications and other liquids, gases and semi-solid materials, the assembly 10 is subject to stresses which can, with time, weaken the assembly 10 and possibly cause what are called "stress risers" in the assembly material which are cracks and holes which can lead to leaking thereby causing the balloon 16 to deflate or the other delivered materials to leak into a non-intended area of the body cavity. In an attempt to minimize this problem, the underside 22 of the base 12 is often configured with bolstering material 28 in the form of what is called a transition neck or strain relief neck to given added integrity to the structure of the assembly. This has been found to be particularly necessary when materials such as silicone are used to form the base 12 and/or the tube 14. This added material 28 is often in contact with the tissue immediately surrounding the stoma 18 and in some instances protrudes down into the stoma 18 as can be seen in FIG. 2. In such cases, this added material 28 can irritate and inflame the tissue surrounding the stoma thereby creating additional discomfort and problems for the patient.

There is therefore a need for an improved enteral feeding device design which helps reduce the potential for stoma irritation and trauma.

SUMMARY OF THE INVENTION

In response to the difficulties and problems discussed herein, the present invention provides an enteral feeding device which includes a base adapted to be deployed outside the human body and a tube which is adapted to be deployed within a lumen of the body by insertion through a stoma. The tube has a proximal end, a distal end, an external diameter and a length between the proximal end and the distal end with the tube defining a longitudinal axis generally parallel to the length of the tube. The base has a top surface and a generally opposed bottom surface, a first end and a second end and a first side and a second side generally opposed to one another and connecting the top and bottom surfaces and the first end and the second end. The proximal end of the tube is connected to and depends away from the bottom surface of the base. The bottom surface of the base has a recess and has two opposing pads near the first and second ends of the base that define a plane which is generally parallel to the bottom surface and generally perpendicular to the longitudinal axis of the tube. The recess is between the pads and is generally concave but smoothly transitions into the first and second sides that extend upwardly from their juncture with the bottom surface in a direction toward the top surface of the base. The recess surrounds the proximal end of the tube and is devoid of material forming either the base or the tube so as to form an air space between the bottom surface of the base and the plane.

If desired, the bottom surface can define one or more passageways between the bottom surface and the plane which permit ambient air to freely circulate into and out of the recess of the base. It is also desirable that the recess be of sufficient size such that during use, the bottom surface of the base is capable of reducing contact with tissue forming the stoma. Additionally it is desired that the recess and/or passageways allow for unobstructed insertion of appropriately sized swabs, e.g. cotton swabs, for cleaning and treatment of the bottom surface of the base and facing tissue. Still another desirable attribute is that the base of the device has no or limited sharp edges which can cause further irritation to the tissue surrounding the stoma.

The enteral feeding device base defines a major axis and a minor axis with the major axis extending through the first and second ends and the minor axis orthogonal to the major axis and extending through the first and second sides. The recess in the bottom surface is generally concave along the major axis and generally flat to convex along the minor axis. The first and second sides of the base can be curved at least in an area adjacent the bottom surface when viewed in a direction parallel to the major axis to shape the recess such that the side portions away from the ends are not associated with the pads. The pads of the bottom surface contact the plane and are designed to rest against tissue surrounding the stoma, support the base, and allow air circulation.

The tube of the device depends away from the bottom surface of the base with minimal to no transition neck around the proximal end of the tube and with no bolstering material or transition neck extending beyond the pads of the base. It is desirable that the external diameter of the tube in the area of the proximal end be of a uniform diameter or, alternatively, of a uniform diameter over a major portion of the length of said tube. In yet another embodiment, the uniform diameter of the tube should extend over a distance of at least 10 millimeters along the length of the tube from the proximal end towards the distal end. Preferably the uniform diameter over the major portion of the length of the tube continues above the plane defined by the pads and into the recess.

One way to facilitate the ability to create the recess, the minimal to no transition neck between the proximal end of the tube and the bottom surface of the base, and the pads is to form, at least in part, the bottom surface and the tube of polyurethane components.

A better understanding of the above and many other features and advantages of the enteral feeding device and its improved base may be obtained from a consideration of the detailed description of the invention below, particularly if such consideration is made in conjunction with the appended drawings.

DEFINITIONS

As used herein the following terms have the specified meanings, unless the context demands a different meaning or a different meaning is expressed; also, the singular generally includes the plural, and the plural generally includes the singular unless otherwise indicated.

As used herein, the terms "comprise," "comprises," "comprising" and other derivatives from the root term "comprise" are intended to be open-ended terms that specify the presence of any stated features, elements, integers, steps, or components, but do not preclude the presence or addition of one or more other features, elements, integers, steps, components, or groups thereof. Similarly, the terms "include", "includes", "including," as well as the terms "has", "have", "having" and derivatives thereof, are intended to be interpreted as the word "comprise", and are intended to be open-ended terms that specify the presence of any stated features, elements, integers, steps, or components, but do not preclude the presence or addition of one or more other features, elements, integers, steps, components, or groups thereof.

As used herein, the terms "substantial" or "substantially" refer to something which is done to a great extent or degree; a significant or great amount; for example, as used herein "substantially" as applied to "substantially" covered means that a thing is at least seventy (70) percent covered.

As used herein, the term "about" adjacent to a stated number refers to an amount that is plus or minus ten (10) percent of the stated number.

As used herein, the term "uniform" in the context of external tube diameter refers to a diameter that does not vary by more than twenty (20) percent over eighty (80) percent of the first 10 millimeters of the tube attached to the base of the enteral feeding device according to the present invention.

These terms may be defined with additional language in the remaining portions of the specification.

DETAILED DESCRIPTION OF THE INVENTION

Figure 1:
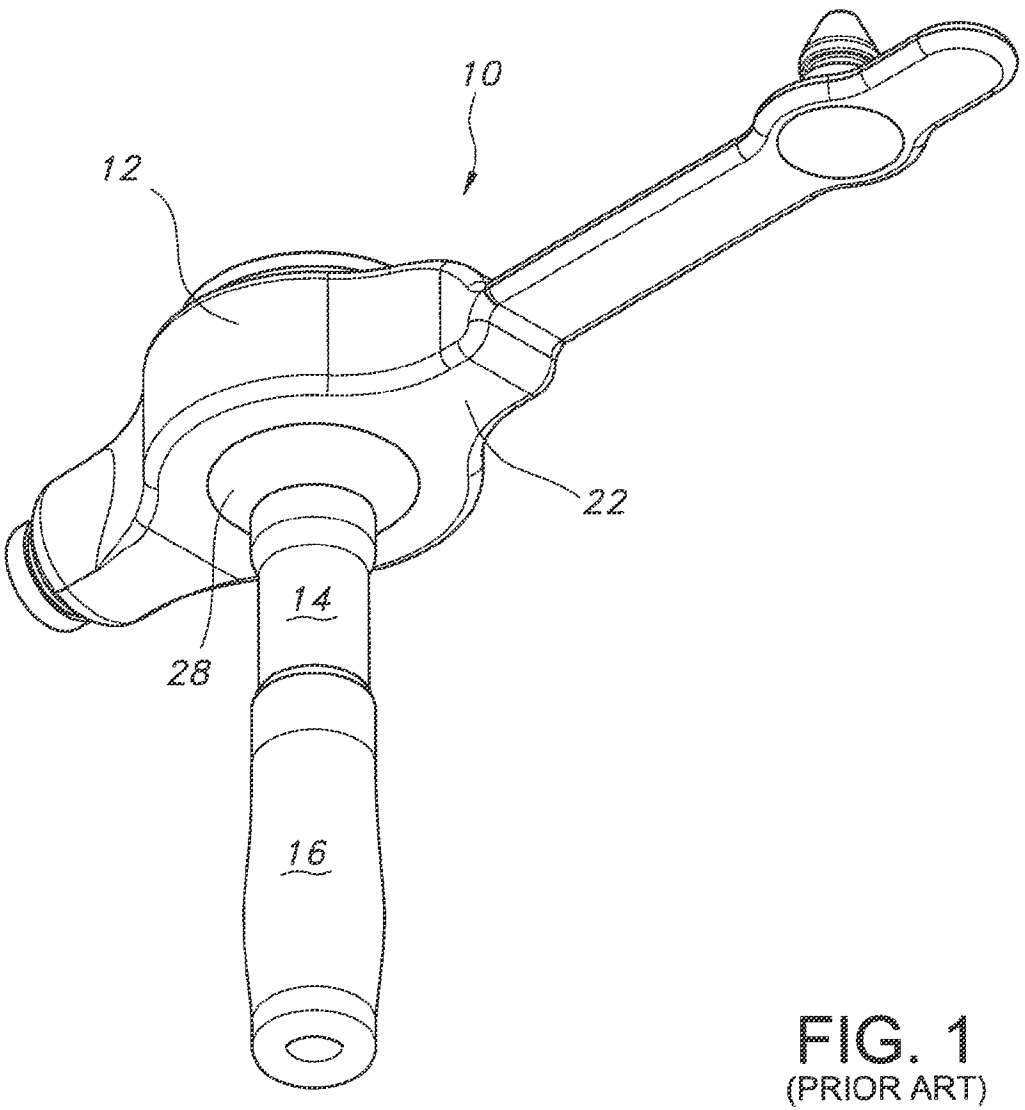
FIG. 1 (PRIOR ART)
FIG. 1 is a perspective view of the exemplary prior art device.
Figure 2:
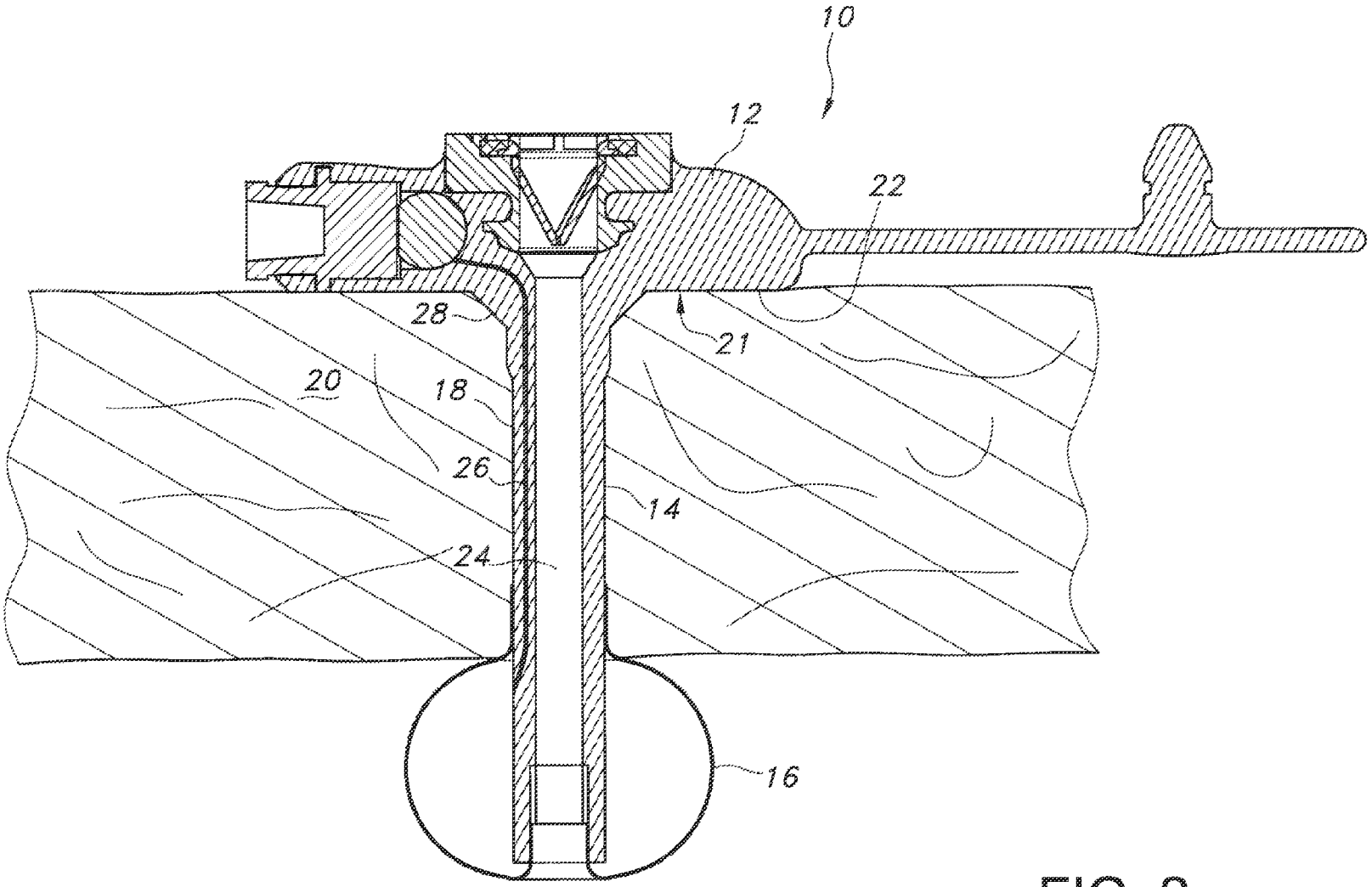
FIG. 2 (PRIOR ART)
FIG. 2 is a cross-sectional side view of the prior art device shown in FIG. 1.
Figure 3:
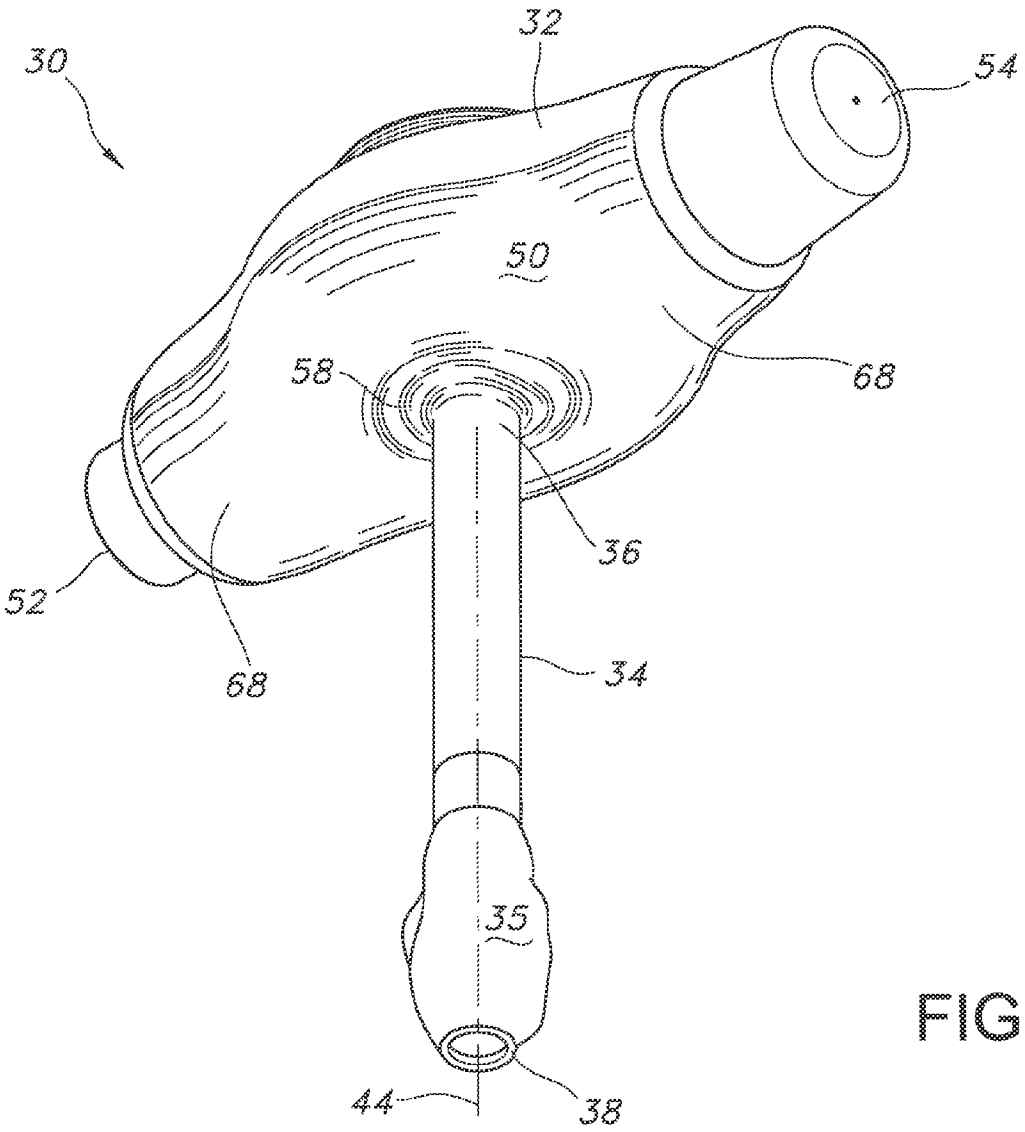
FIG. 3 is a perspective view of an enteral feeding device according to the present invention showing the bottom surface of the base.
Figure 4:
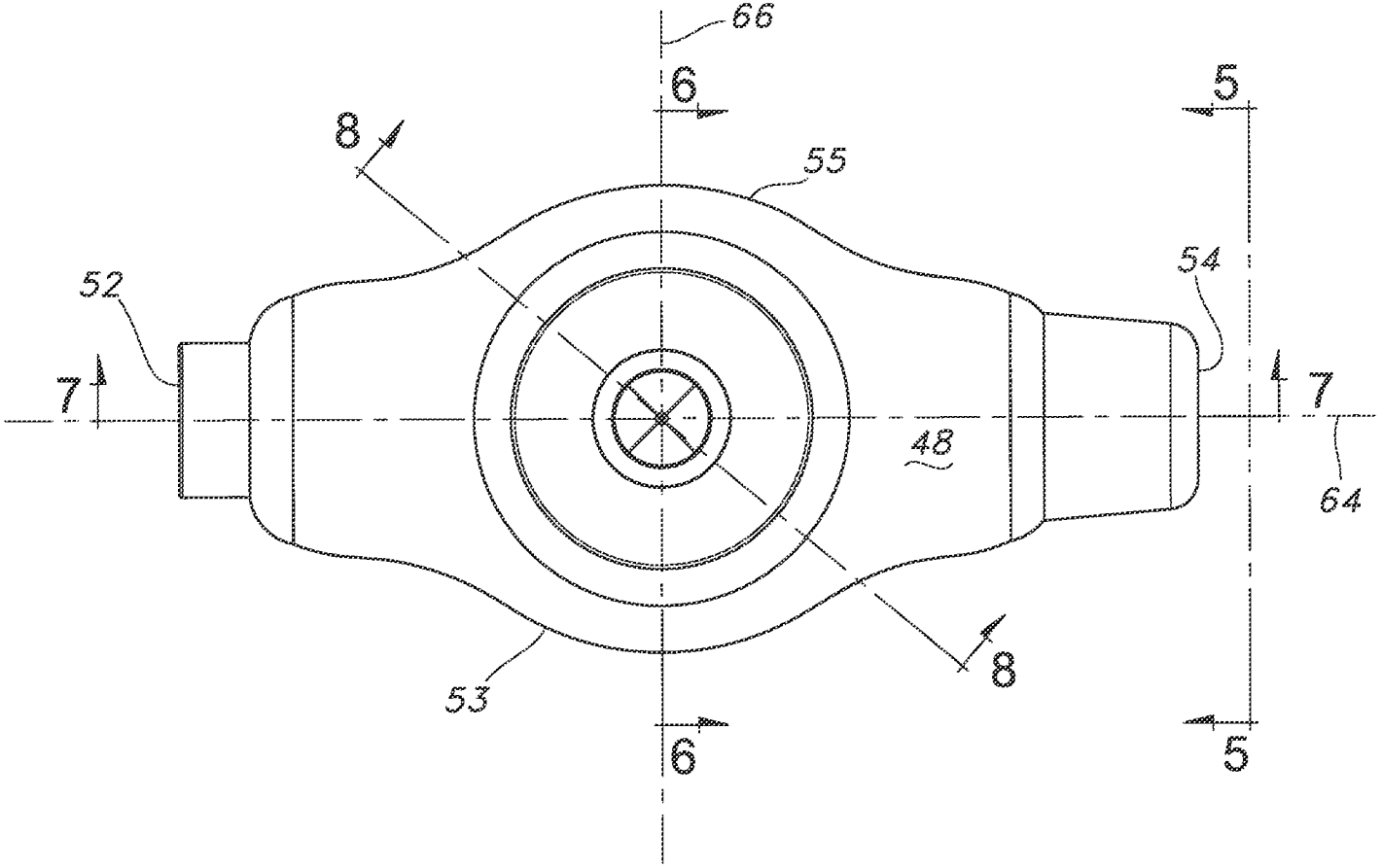
FIG. 4 is a top plan view of an enteral feeding device according to the present invention.

The invention(s) disclosed herein relate generally to improved medical care for patients who require enteral feeding. More particularly, the invention(s) disclosed herein relate to an enteral feeding device having an improved base deployed outside the human body, a tube for transfer of material from outside the body to the inside of the body and, optionally, an indwelling retainer which is deployed within a lumen of the body by insertion through a stoma. The device has base and tube designs intended to reduce irritation of the tissue immediately surrounding the stoma.

In one embodiment of the present invention, the enteral feeding device base uses a reverse hourglass shape when viewed from the top to provide a functional base within the limited amount of space. The design of the base incorporates two "pads" that are formed on the underside of the base. These atraumatic "pads" rest against the body and distribute pressure against the body at locations distanced from the stoma. As a result, the improved base of the present invention provides all the functions of a conventional device with the added features which reduce stoma irritation and trauma. In the vicinity of the device immediately surrounding the proximal end of the tube, the base design allows for air circulation at the stoma site to improve stoma formation and stoma health while also allowing for easier cleaning of the stoma site. This design is also very smooth against the body and does not have any sharp edges. In addition, the improved base design and ergonomics allow for easy gripping of the base while attaching extension sets. For a general description of how such conventional enteral feeding devices operate see, for example, U.S. Pat. No. 5,995,546 to Foster et al. which is incorporated herein by reference in its entirety to the extent not inconsistent herewith.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Referring now to FIGS. 3 through 8 of the drawings, there is illustrated an improved enteral feeding device 30 having a base 32 adapted to be deployed outside the human body and a tube 34 adapted to be deployed transcutaneously within the body by insertion through a stoma 18. Desirably, the device is deployed from outside the body. Optionally, the device 30 may include and inflation balloon 35 for retaining the device 30 in place and making it difficult for the tube 34 to be inadvertently removed from its intended location. The device will also have an inflation lumen 37 and feeding/delivery lumen 39 such as with conventional enteral feeding tube devices, the design and use of which is well known.

The tube 34 has a proximal end 36, a distal end 38 with an external diameter 40 and a length 42 between the proximal end 36 and the distal end 38. The tube 34 defines a longitudinal axis 44 which is generally parallel to the length 42 of the tube 34.

The base 32 has a top surface 48 and a generally opposed bottom surface 50 joined to a first end 52 and a second end 54 of the base. The base 32 further has a first side 53 and a second side 55 generally opposed to one another and further joined to the top surface 48, the bottom surface 50, the first end 52 and second end 54.

In the embodiment shown in the Figures, the base 32 has generally oblong or elliptical shapes with respect to top, bottom, side and end views so that the base 32 defines a major axis 64 and a minor axis 66 with the major axis extending through the first end 52 and the second end 54 and the minor axis 66 extending through first side 53 and the second side 55. See FIGS. 4, 6 and 7. When viewed parallel to the minor axis 66, the base 32 has a generally concave shape adjacent the bottom surface 50 and generally convex shape when viewed parallel to the major axis 64. Note, however, that other base shapes are also considered to be within the scope of the present invention provided they impart the intended attributes disclosed herein.

The proximal end 36 of the tube 34 is connected to and depends away from the bottom surface 50 of the base 32. The bottom surface 50 of the base 32 defines a plane 56 which is generally parallel to the bottom surface 50 and generally perpendicular to the longitudinal axis 44 of the tube 34. See FIGS. 5, 6 and 7. This is the plane which is intended to replicate the location where the device 30 contacts the user. While the tube 34 is shown as centrally depending from the base 32, off-centered positions are possible.

To allow air circulation and to minimize contact of the base 32 with the tissue 20 at or near an exterior surface 21 that is surrounding the stoma 18, the bottom surface 50 of the base 32 is provided with or defines at least one recess 58, which is generally concave between the first end 52 and a second end 54, and extends upwardly from the plane 56 in a direction toward the top surface 48 of the base 32. See FIGS. 3 and 5-7. The recess 58 surrounds at least a portion of the proximal end 36 of the tube 34 and the recess 58 is devoid of material forming either the base 32 or the tube 34. As a result, the recess 58 forms an air space between the bottom surface 50 of the base 32 and the plane 56.

Due to the shape of the base 32, one or more passageways 62 can be formed in the bottom surface 50 of the base 32 which permit air to circulate into and out of the recess 58 from ambient air surrounding the base 32. As can be seen in the drawings, these passageways 62 are created by the gentle curving up of the first 53 and second sides 55 adjacent the bottom surface 50 so that the curved areas 63 permit air flow into the recess 58 from the sides of the device 30. Furthermore, this gentle curving up of the first and second sides (53 and 55 respectively) extends along the major axis 64 from the first end 52 to the second end 54. As a result, there are no sharp edges to protrude into the tissue 21 surrounding the stoma 18 which can cause irritation and discomfort.

The passageways 62 can take on any number of shapes and such shapes are intended to be within the scope of the present invention. For example, deeper grooves (not shown) can be formed into the base 32 at any point around the proximal end 36 of the tube 34. The size and volume of the recess 58 should be such that the ambient air can freely circulate about the base 32 and so that the bottom surface 50 of the base 32 is capable of avoiding or at least reducing contact with the tissue surrounding the stoma 18. Additionally, passageways 62 allow access for cleaning within the recess 58 and stoma tissue surfaces. In this regard, it is desirable that the recess 58 be of sufficient size such that a cotton swab or other suitable cleaning devices can be inserted into the recess 58 for cleaning and other tasks.

Figure 6:
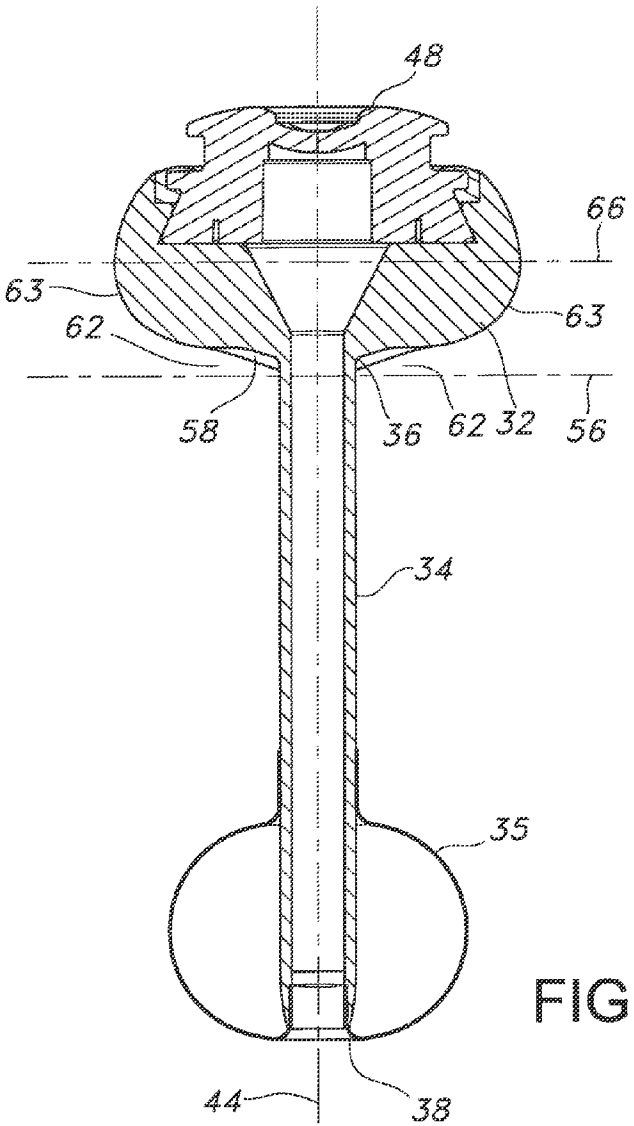
FIG. 6 is a cross-sectional end view of an enteral feeding device according to the present invention taken along line 6-6 of FIG. 4.
Figure 7:
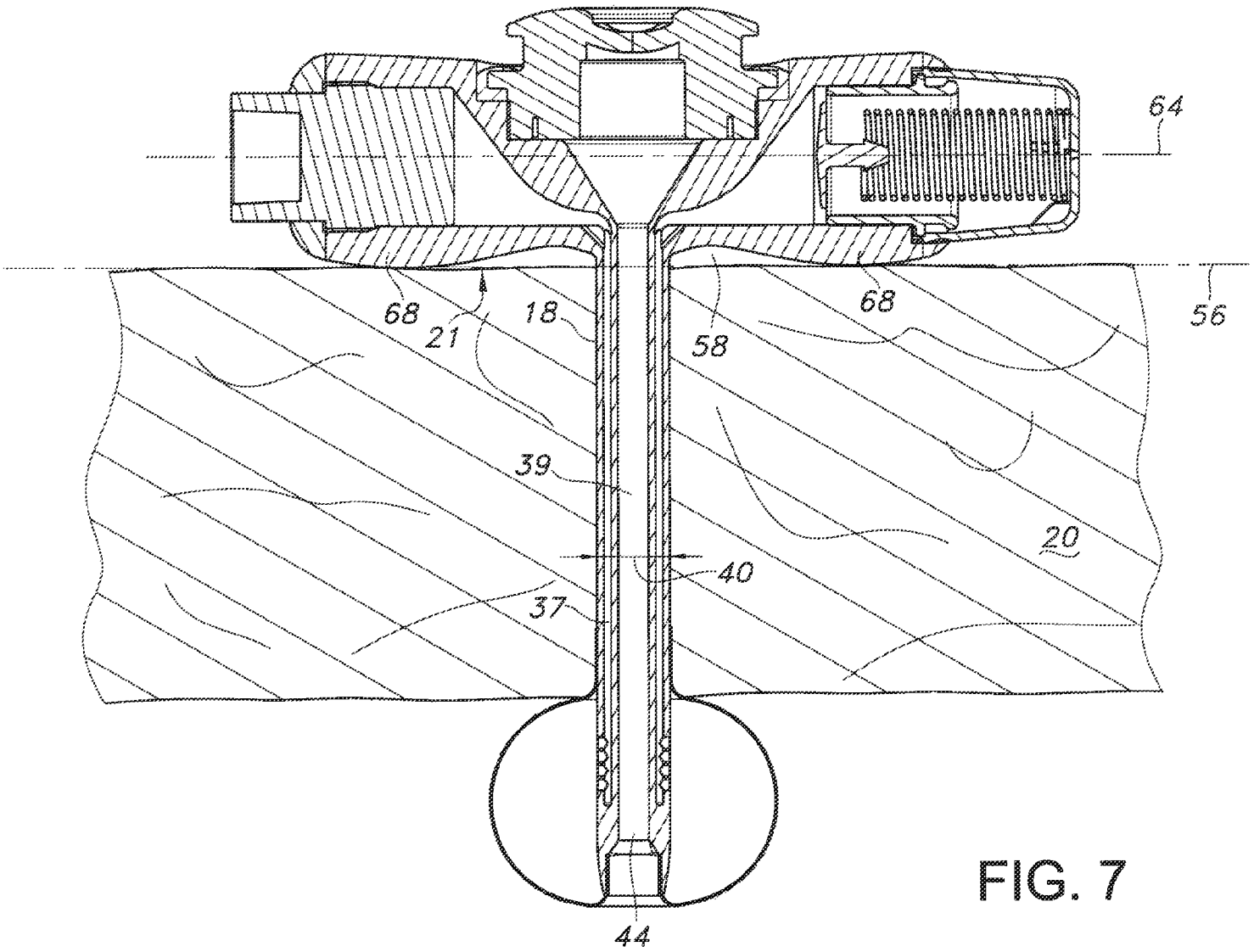
FIG. 7 is a cross-sectional side view of an enteral feeding device according to the present invention taken along line 7-7 of FIG. 4.
Figure 8:
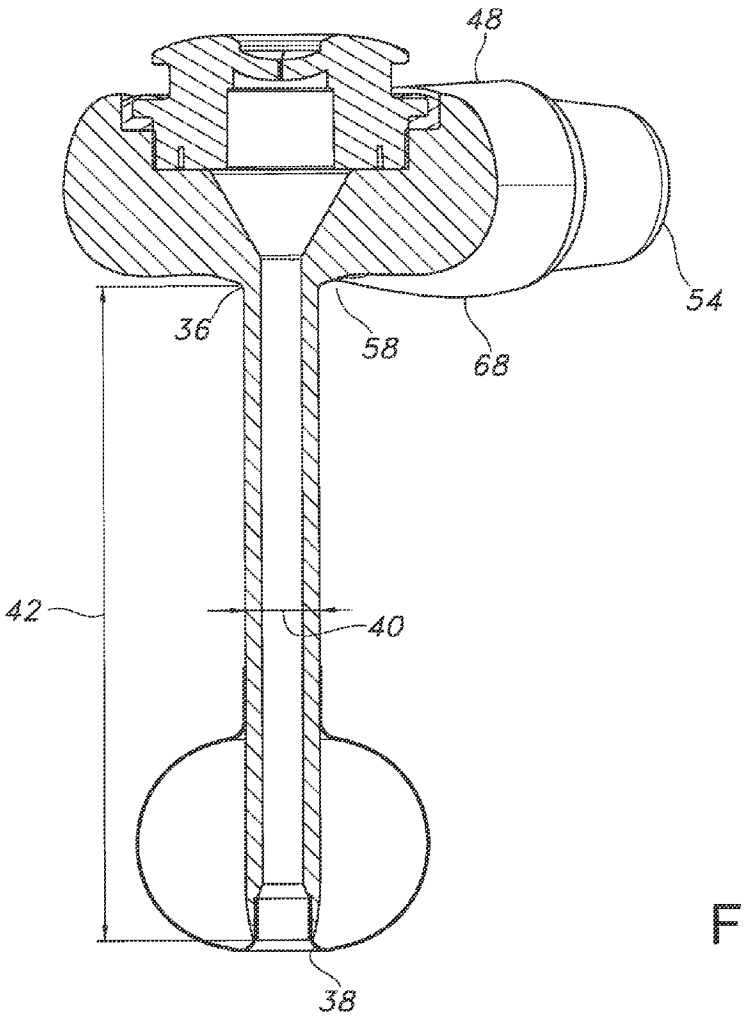
FIG. 8 is a cross-sectional side view of an enteral feeding device according to the present invention taken along line 8-8 of FIG. 4.

In the embodiment shown in the Figures, the base 32 has a generally oblong or elliptical shape and so the base 32 defines a major axis 64 and a minor axis 66 with the major axis extending through the first end 52 and the second end 54 and the minor axis 66 extending through first side 53 and the second side 55. See FIGS. 4, 6 and 7. The recess 58 in the bottom surface 50 of the base 32 is generally concave along the major axis 64 as can be seen in FIG. 7 when viewing the base 32 along and parallel to the minor axis 66 even though there can be slight dipping of the bottom surface 50 immediately adjacent the proximal end 36 of the tube 34. As shown in FIGS. 6 and 7 any slight dipping of the bottom surface 50 immediately adjacent the proximal end 36 of the tube 34 is always within the recess, i.e. above the plane 56. As indicated in FIG. 8 the length 42 of the tube 34 is of a uniform exterior diameter toward the proximal end 36 and this uniform diameter extends into the recess 58. Also note that the generally concave configuration can contain various other surface contours and irregularities provided the overall shape has a concave configuration. Thus the term "concave" is meant to include any shape that results in the formation of a recess 58 in the bottom surface 50 of the base 32.

Figure 5:
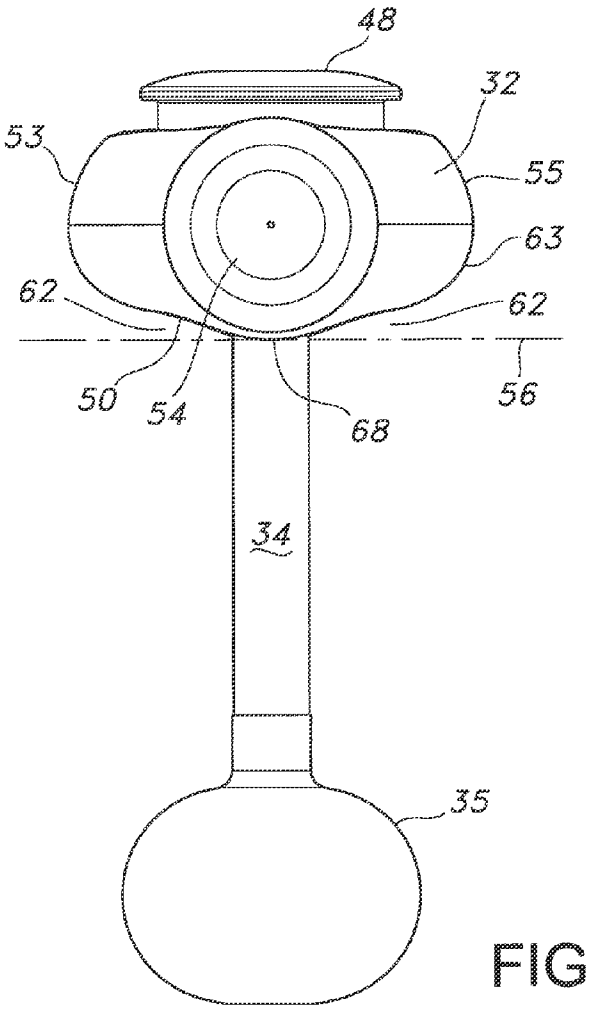
FIG. 5 is an end view of an enteral feeding device according to the present invention taken along line 5-5 of FIG. 4.

When viewing the base 32 along and parallel to the major axis 64, as can be seen in FIGS. 5 and 6, the recess 58 can comprise concave features in the area immediately surrounding the proximal end 36 of the tube 34 but then the sides become convex adjacent the first 53 and second 55 sides as shown by the curved areas 63 of the base 32. Thus, the recess 58 in the bottom surface 50 can be generally concave along the major axis 64 (when viewed along the minor axis 66).

Due to the curvatures in the bottom surface 50 of the base 32 that form the recess 58, a pair of pads 68 are formed adjacent the first 52 and second 54 ends which contact the plane 56 and are designed to rest against tissue surrounding the stoma 18, to support and elevate the rest of the base 32, allow air circulation, and provide ready access for cleaning surface tissue not occluded by the pads 68. Here again, the pads 68 can take on any number of shapes and such shapes are intended to be within the scope of the present invention. The pads 68 in the base 32 can also be located at any location and in any number around the proximal end 36 of the tube 34. As shown in FIG. 7 the bottom surfaces of the pads may be curved, however other bottom surfaces for the pads are possible, such as flat, partially recessed, undulated, and their combinations.

In intentionally designing the base 32 to allow greater air circulation and less irritation of the tissue surrounding the stoma 18, it was found advantageous to switch from conventional materials for formation of the tube 34, such as silicone, to other materials. In particular, it was determined that using polyurethane or materials that include polyurethane for the tube 34 and, optionally, the base 32 enables a major portion or the entire length 42 of the tube 34 to have a uniform external diameter 40 as close to the proximal end 36 of the tube 34 as possible while reducing the frequency and severity of the "stress risers" previously mentioned as being a problem with prior art feeding tube assembly designs.

A proven way to achieve the fit and function of the enteral feeding device 30 is to form the tube 34 of a material that is generally harder, tougher and/or less rubbery than silicone tubing conventionally used for enteral feeding tubes. As an example, the tube 34 may be formed of a material having a Shore Hardness of from about 65 A to about 80 A and an ultimate tensile of between about 2500 to about 6000 pounds per square inch (psi). While such a material may have a tensile force of 300 psi at an elongation about 100 percent and/or a tensile force of 500 psi at an elongation about 200 percent (which may be similar to some conventional silicone elastomeric materials) the greater hardness and ultimate tensile is thought to make the tube 34 more resistant to stretching while still retaining flexibility. Exemplary materials include thermoplastic polyurethanes such as TECOFLEX® medical-grade aliphatic polyether polyurethanes available from Lubrizol Advanced Materials, Inc., Thermedics™ Polymer Products, Wilmington, Mass. For example, TECOFLEX® EG-80A has been found to work particularly well. Table 1 below provides some representative properties for TECOFLEX® EG-80A.

TABLE 1

| | ASTM Test | TECOFLEX ® EG-80A |
|---|---|---|
| Durometer (Shore Hardness) | D2240 | 72A |
| Specific Gravity | D792 | 1.04 |
| Flexural Modulus (psi) | D790 | 1,000 |
| Ultimate Tensile (psi) | D412 | 5,800 |
| Ultimate Elongation (%) | D412 | 660 |
| Tensile (psi) at 100% Elongation | D412 | 300 |
| Tensile (psi) at 200% Elongation | D412 | 500 |
| Tensile (psi) at 300% Elongation | D412 | 800 |

As noted above, the material of the tube 34 may desirably have a Shore Hardness of from about 65 A to about 80 A. The Shore Hardness testing of plastics is most commonly measured by the Shore (Durometer) test using either the Shore A or Shore D scale. The Shore A scale is used for "softer" rubbers while the Shore D scale is used for "harder" ones. The Shore A Hardness is the relative hardness of elastic materials such as rubber or soft plastics can be determined with an instrument called a Shore A Durometer. If the indenter completely penetrates the sample, a reading of 0 is obtained, and if no penetration occurs, a reading of 100 results. The reading is dimensionless.

The Shore hardness is measured with an apparatus known as a Durometer and is sometimes also referred to as Durometer Hardness. The hardness value is determined by the penetration of the Durometer indenter foot into the sample. Because of the resilience of rubbers and plastics, the hardness reading may change over time so the indentation time is sometimes reported along with the hardness number. The ASTM test number is ASTM D2240 while the analogous ISO test method is ISO 868.

Thus, exemplary embodiments of the invention are presented herein; however, the invention may be embodied in a variety of alternative forms, as will be apparent to those skilled in the art. To facilitate understanding of the invention, and provide a basis for the claims, various figures are included in the description. The figures are not drawn to scale and related elements may be omitted so as to emphasize the novel features of the invention. Structural and functional details depicted in the figures are provided for the purpose of teaching the practice of the invention to those skilled in the art and are not intended to be considered limitations. Directional terms such as left, right, front or rear are provided to assist in the understanding of the invention and are not intended to be considered as limitations.

While particular embodiments of the present invention have been described herein; it will be apparent to those skilled in the art that alterations and modifications may be made to the described embodiments without departing from the scope of the appended claims.

We claim:

1. An enteral feeding device comprising a base adapted to be deployed outside the human body and a tube which is adapted to be inserted through a stoma from outside the body;

said tube having a proximal end, a distal end, an external diameter and a length between said proximal end and said distal end, said tube defining a longitudinal axis generally parallel to said length of said tube;

said base having a top surface and a generally opposed bottom surface, a first end and a second end, and a first side and a second side generally opposed to one another and connecting said top and bottom surfaces and said first end and said second end;

said proximal end of said tube being connected to and depending away from said bottom surface of said base;

said bottom surface of said base defining a plane generally parallel to said bottom surface and generally perpendicular said longitudinal axis of said tube;

said bottom surface defining a recess which extends upwardly from said plane in a direction toward said top surface of said base, said recess directly surrounding said proximal end of said tube and forming an air space between said bottom surface of said base and said plane;

said base defining a major axis and a minor axis, said major axis extending through said first and second ends and said minor axis extending through said first and second sides;

said recess in said bottom surface being generally concave along said major axis in the areas immediately surrounding said proximal end of said tube when viewed along said minor axis, said bottom surface gently curving up and away from said proximal end of said tube and then curving downwardly toward said plane so as to form a pair of pads which are in contact with said plane, one of the pads of said pair of pads being adjacent said first end and the other one of said pads being adjacent said second end, each of said pads forming a point of contact with said plane which is inboard of said first end and said second end, and said bottom surface of said base being generally convex along said minor axis, and said first and second sides of said base being curved upwardly at least in an area adjacent said bottom surface when viewed in a direction parallel to said major axis so as to form curved areas in said bottom surface which permit air to circulate into and out of said recess in said base from said first and second sides of said device.

2. The enteral feeding device of claim 1 wherein said tube is formed, at least in part, of polyurethane.

3. The enteral feeding device of claim 1 wherein said external diameter of said tube in an area of said proximal end is of a uniform diameter.

4. The enteral feeding device of claim 3 wherein said uniform diameter of said tube extends over a major portion of said length of said tube.

5. The enteral feeding device of claim 3 wherein said uniform diameter of said tube extends a distance of at least 10 millimeters along said length of said tube from said proximal end towards said distal end.

6. The enteral feeding device of claim 1 wherein said device is comprised, at least in part, of polyurethane.

* * * * *